US010913105B2

(12) United States Patent
Gomez et al.

(10) Patent No.: US 10,913,105 B2
(45) Date of Patent: Feb. 9, 2021

(54) METHOD FOR PRODUCING A PATTERN FOR LOST PATTERN CASTING

(71) Applicant: Safran Aircraft Engines, Paris (FR)

(72) Inventors: Pascal Gomez, Moissy-Cramayel (FR); Umberto Aprile, Moissy-Cramayel (FR); Philippe Chabaneix, Moissy-Cramayel (FR); Dominque Coyez, Moissy-Cramayel (FR); Chantal Sylvette Langlois, Moissy-Cramayel (FR); Daniel Quach, Moissy-Cramayel (FR); Isabelle Marie Monique Valente, Moissy-Cramayel (FR); Matthieu Jean Luc Vollebregt, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 343 days.

(21) Appl. No.: 15/570,011

(22) PCT Filed: Apr. 26, 2016

(86) PCT No.: PCT/FR2016/050980
§ 371 (c)(1),
(2) Date: Oct. 27, 2017

(87) PCT Pub. No.: WO2016/174344
PCT Pub. Date: Nov. 3, 2016

(65) Prior Publication Data

US 2018/0154427 A1 Jun. 7, 2018

(30) Foreign Application Priority Data

Apr. 30, 2015 (FR) ..... 15 53937

(51) Int. Cl.
*B22C 7/02* (2006.01)
*B22C 9/04* (2006.01)
(Continued)

(52) U.S. Cl.
CPC ..... *B22C 7/02* (2013.01); *B22C 7/026* (2013.01); *B22C 9/04* (2013.01); *B22C 9/103* (2013.01); *B22C 13/085* (2013.01)

(58) Field of Classification Search
CPC .. B22C 7/00; B22C 7/02; B22C 7/023; B22C 7/026; B22C 9/04; B22C 9/043;
(Continued)

(56) References Cited

U.S. PATENT DOCUMENTS 3,981,344 A 9/1976 Hayes et al.
5,465,780 A * 11/1995 Muntner ..... B22C 9/04 164/516

(Continued)

FOREIGN PATENT DOCUMENTS

CN 101204726 B 3/2013
DE 10038453 A1 2/2002

(Continued)

OTHER PUBLICATIONS

International Search Report and English translation dated Jun. 22, 2016, in International Application No. PCT/FR2016/050980 (5 pages).

(Continued)

*Primary Examiner* — Kevin P Kerns
*Assistant Examiner* — Steven S Ha
(74) *Attorney, Agent, or Firm* — Bookoff McAndrews, PLLC

(57) ABSTRACT

A fabrication method for fabricating a pattern for lost pattern casting, comprising at least one insert (10), providing at least two pattern portions (12, 14), said at least two portions being made of a material that can be eliminated, and assembling said at least two pattern portions together around at least a portion of said at least one insert in sealed manner so as to make said pattern (16).

8 Claims, 6 Drawing Sheets

(51) Int. Cl.
*B22C 9/10* (2006.01)
*B22C 13/08* (2006.01)

(58) Field of Classification Search
CPC ..... B22C 9/046; B22C 9/103; B22C 9/10; B22C 9/108; B22C 9/101; B22C 9/105; B22C 9/22; B22C 9/24; B22C 13/085
See application file for complete search history.

(56) References Cited

U.S. PATENT DOCUMENTS

| | | | | |
|---|---|---|---|---|
| 2002/0108717 | A1* | 8/2002 | Geertsen ..... | B22C 7/026 156/575 |
| 2009/0229780 | A1 | 9/2009 | Shelley, Jr. et al. | |
| 2010/0294451 | A1 | 11/2010 | Paul | |

FOREIGN PATENT DOCUMENTS

| | | | | | |
|---|---|---|---|---|---|
| EP | 1930096 | A1 | | 6/2008 | |
| GB | 939328 | A | * | 10/1963 | ..... B22C 7/02 |
| GB | 2150874 | A | * | 7/1985 | ..... B22C 7/02 |
| WO | WO 2014/049223 | A2 | | 4/2014 | |

OTHER PUBLICATIONS

Chinese Office Action in Chinese Patent Application No. 2016800267378, dated Sep. 23, 2019 (7 pages).

* cited by examiner

METHOD FOR PRODUCING A PATTERN FOR LOST PATTERN CASTING

CROSS-REFERENCE TO RELATED APPLICATIONS

This application is the U.S. national phase entry under 35 U.S.C. § 371 of International Application No. PCT/FR2016/050980, filed on Apr. 26, 2016, which claims priority to French Patent Application No. 1553937, filed on Apr. 30, 2015, the entireties of which are herein incorporated by reference.

FIELD OF THE INVENTION

The invention relates to fabricating patterns for lost pattern casting. The term "pattern for lost pattern casting" or more simply "casting patterns" or even "pattern" (or "model") are used herein to designate a part that can be made at least in part out of a material that can be eliminated, and that has substantially the same shape as the part that it is desired to fabricate.

In the present context (of a casting pattern), the fact that the material can be eliminated means that the material can be eliminated without destroying or damaging the mold formed around the casting pattern. This elimination may be done by chemical means (baths, . . . ), and/or thermal means, and/or other means. For example, the material that can be eliminated may merely be a material that melts at low temperature. The term "melt at low temperature" is used herein to mean that it melts at a temperature of less than 500° C., and preferably less than 100° C.

A pattern may include one or more inserts, which are parts that are integrated in the pattern either in order to enable it to be fabricated, or else in order to form a portion of the part that is to be fabricated.

Lost pattern casting is a known method that usually comprises the following steps: fabricating casting patterns; forming a shell mold around the patterns; eliminating the patterns (with the exception of any insert(s)) by heating the mold: the patterns melt and/or burn off (with the exception of any insert(s)); and the material constituting them is then removed from the mold. The shell mold is then used for making parts by casting.

The invention relates more precisely to fabricating patterns for lost pattern casting that include respective inserts. Such patterns are used for fabricating parts that themselves include an insert, or else for fabricating parts that are hollow: under such circumstances, the insert of the casting pattern is a core that serves to define the hollow portion of the part while molten metal is being cast, and it is subsequently eliminated after the mass of metal has cooled.

TECHNOLOGICAL BACKGROUND

Patterns for lost pattern casting are usually fabricated by injection molding. It is therefore necessary to fabricate a specific mold, which mold is generally complex.

Also, since in order to produce patterns it is thus necessary to design and make such a mold, the fabrication of patterns is expensive, in particular for short runs; furthermore, a relatively long period of time elapses between the moment when the digital definition is available for the pattern that is to be fabricated, and the moment when the mold for fabricating the pattern is available in order to enable patterns to be fabricated. (The term "digital definition" as used above designates the digital file defining the (three-dimensional) shape of a part, e.g. the shape of a pattern that is to be fabricated. The file is usually obtained with the help of computer assisted design (CAD) software such as CATIA (trademark registered by the supplier Dassault Systemes).

SUMMARY OF THE INVENTION

The object of the invention is thus to propose a method of fabricating casting patterns, for fabricating casting patterns that include respective inserts, in a manner that is faster and less expensive than the above-described traditional method.

This object is achieved by a fabrication method for fabricating an lost pattern casting pattern, the method comprising the following steps:

S1A) providing at least one insert;

S1B) providing at least two pattern portions, said at least two portions being made of a material that can be eliminated; and S2) assembling said at least two pattern portions together around at least a portion of said at least one insert in sealed manner so as to make said pattern.

The insert(s) may in particular comprise a core that is designed to be eliminated after the casting step during the lost pattern casting. The core(s) may in particular be one or more ceramic cores. One or more inserts may also be permanent inserts, designed to be integrated in the part, e.g. in order to reinforce it mechanically.

The pattern is formed by uniting said at least two portions. Consequently, the shape of the pattern is the combination of shapes (or volumes) of its various portions.

Because the casting pattern is made by assembling a plurality of pattern portions together, the above method gives great flexibility that is greater than the traditional method by injection molding in a mold.

Specifically, each of the various portions of the pattern are simpler to fabricate than the pattern itself; in particular because the portions do not include an insert. Advantageously, it is thus possible to fabricate these pattern portions by methods that do not require the use of specific tooling.

In particular, step S1B) of fabricating one or more pattern portions may be performed by fabricating one or more of said pattern portions by an additive method. It may also be performed by injection molding. It may also be performed by any other method that is appropriate for fabricating a pattern portion.

The same applies to fabricating the insert(s): step S1A) of providing the insert(s) may be performed by fabricating the insert(s) by an additive method, by injection molding, or indeed any other appropriate method.

Nevertheless, making the pattern by assembling its portions together around one or more inserts in step S2), requires certain precautions to be taken.

In particular, it is necessary to exclude any of the material that is used for making the shell mold from infiltrating into the inside of the pattern (i.e. between an insert and a pattern portion).

Since the shell mold is fabricated using the pattern by immersing the pattern in a slurry, it can be understood that this requires the casting pattern to be perfectly sealed, i.e. for it to be impossible for the slurry to penetrate between the portions of the pattern in contact with the insert. In other words, the term "seal" means that the connection zones between the pattern portions and the insert and/or between the various pattern portions do not allow any foreign body to pass, just like the working portions of the remainder of the pattern.

That is why, in step S2, "said at least two pattern portions are assembled together around at least one portion of said at least one insert in sealed manner". In certain implementations, said at least two pattern portions are assembled in sealed manner around the entire insert. Thus, the insert(s) does/do not project outside the pattern: they are strictly contained inside it and they are separated in sealed manner from the space outside the pattern. In other implementations, the pattern portions are assembled together in sealed manner around only a portion of the insert. Thus, after the pattern portion(s) has/have been put into place the insert(s) may project outside the pattern; the projecting portions of the inserts are referred to as appendices. In such implementations, it is then ensured that the pattern portions are assembled in sealed manner around the appendices. To do this, it is possible to rework the sealing of the at least two pattern portions, e.g. using a small hot iron. These appendices of the insert(s) projecting from the pattern portion(s) may be of use in the casting process, in particular for anchoring the insert in the shell mold, e.g. in order to guarantee wall thicknesses for the final part or to maintain and control the dimensions of the hollow cavity.

That said, it can be understood that the pattern is sealed naturally with the exception of passages for feeding and removing material as required for the lost pattern casting method.

Since the various portions of the casting pattern are generally made of material that melts when hot, it has been found that it is possible to make local use of the melting properties of this material for the purpose of sealing the casting pattern during fabrication step S2). Naturally, any other appropriate method for sealing the pattern during step S2) could be used (in particular by adding a sealing resin, etc.), in particular if the pattern portions are not made out of a material that melts when hot.

Because of this precaution that consists in sealing the pattern fabricated by assembling pattern portions together, the pattern that is obtained at the end of step S2) can be used as a casting pattern and in particular can be used for fabricating a shell mold.

In a preferred implementation, step S2) of the method comprises two substeps:

S21) assembling said at least two pattern portions around said at least one portion of said at least one insert by adhesive (by gluing) or by welding; and S22) sealing the pattern as made in this way.

The method is applicable in particular to fabricating casting patterns having an aerodynamic profile.

The method is applicable in particular to fabricating casting patterns including an airfoil.

Under such circumstances, in a preferred implementation of the method, in step S1B), exactly two pattern portions are provided, a pressure side portion including the portion of the airfoil situated on the pressure side, and the suction side portion including the portion of the airfoil situated on the suction side.

The invention also provides a method of fabricating a part by lost pattern casting, in which a pattern is fabricated by the above-described method.

The invention also provides a pattern for lost pattern casting that comprises at least two portions that are not formed together integrally and at least one insert, said at least two portions being fastened together in sealed manner around at least a portion of said at least one insert; said at least two portions being made of a material that can be eliminated; and said at least one insert having a melting temperature higher than 1300° C. The insert is thus made of a material having a melting temperature higher than the melting temperature of the metal.

BRIEF DESCRIPTION OF THE DRAWINGS

The invention can be well understood and its advantages appear better on reading the following detailed description of implementations given as non-limiting examples. The description refers to the accompanying drawings, in which.

DETAILED DESCRIPTION OF THE INVENTION

Figure 1:
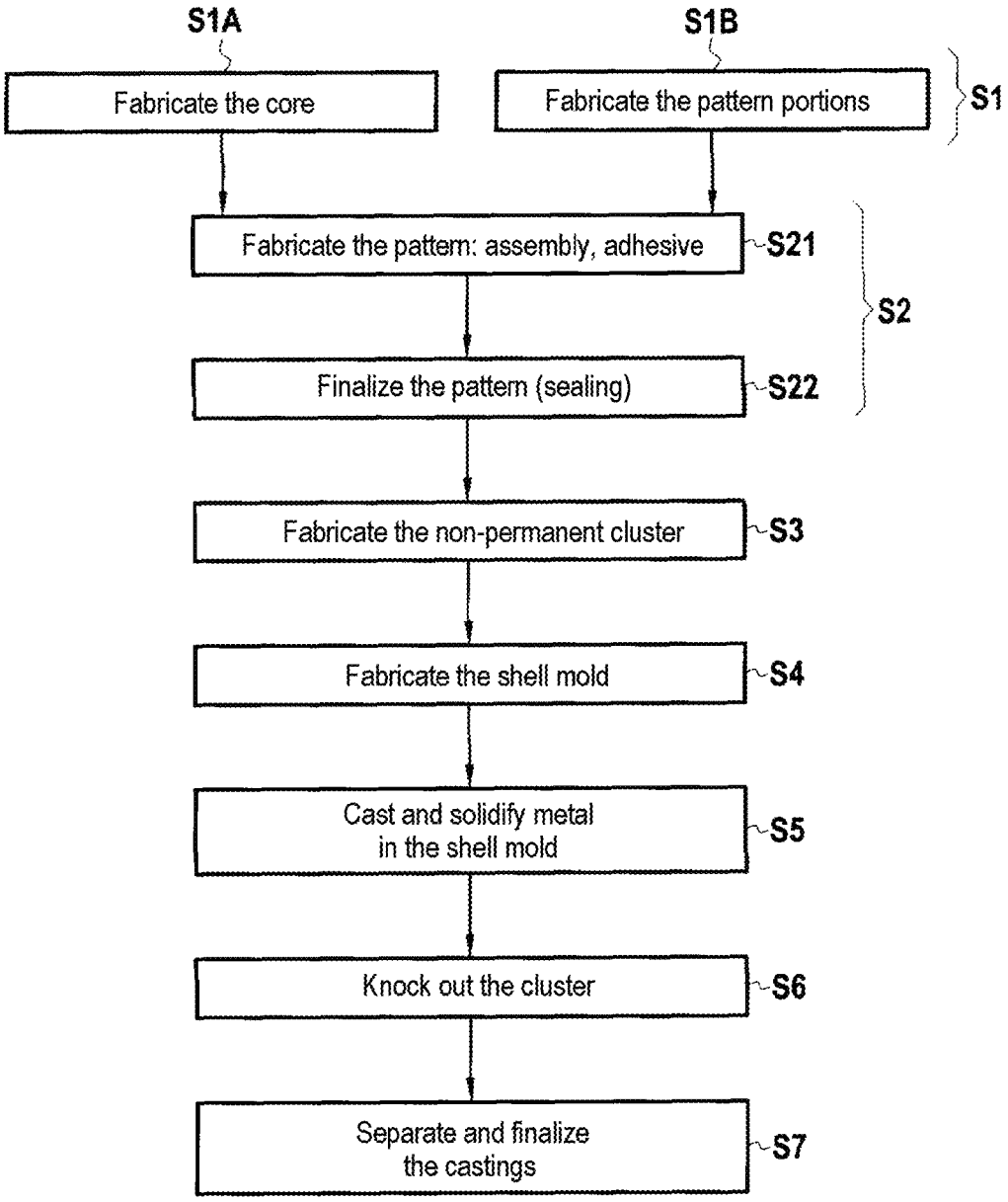
FIG. 1 is a diagrammatic view of a method of fabricating blades, constituting an implementation of the invention.

The method of fabricating blades as shown in FIG. 1 is an lost pattern casting method.

By way of non-limiting example, the method is described in the context of fabricating a cluster of twelve blades for a turbine engine.

The method comprises seven steps S1 to S7. Steps S1 and S2 are identical for each of the twelve blades. They are therefore described in the context of a single blade; in practice, it is necessary to perform these steps for each of the twelve blades.

S1: Fabricating the Core and Portions of the Pattern

This step S1 comprises two operations that are performed in parallel:

during a step S1A, a core (10) is fabricated; and during a step S1B, the portions (12, 14) of the pattern are fabricated.

In general, a digital definition is available of the part that is to be fabricated.

In order to perform the method, it is therefore necessary to define the portions of the pattern on the basis of the digital definition of the part.

This operation may be performed by any means.

The method consists in creating digital definitions of the portions of the pattern from the digital definition of the part. For this purpose, the part is subdivided into a plurality of portions.

For example, if the part includes an airfoil (as in the example shown), the part may be subdivided into a suction side portion 12 including the portion of the airfoil that is situated on the suction side, and a pressure side portion 14 including the portion of the airfoil that is situated on the pressure side.

Figure 3:
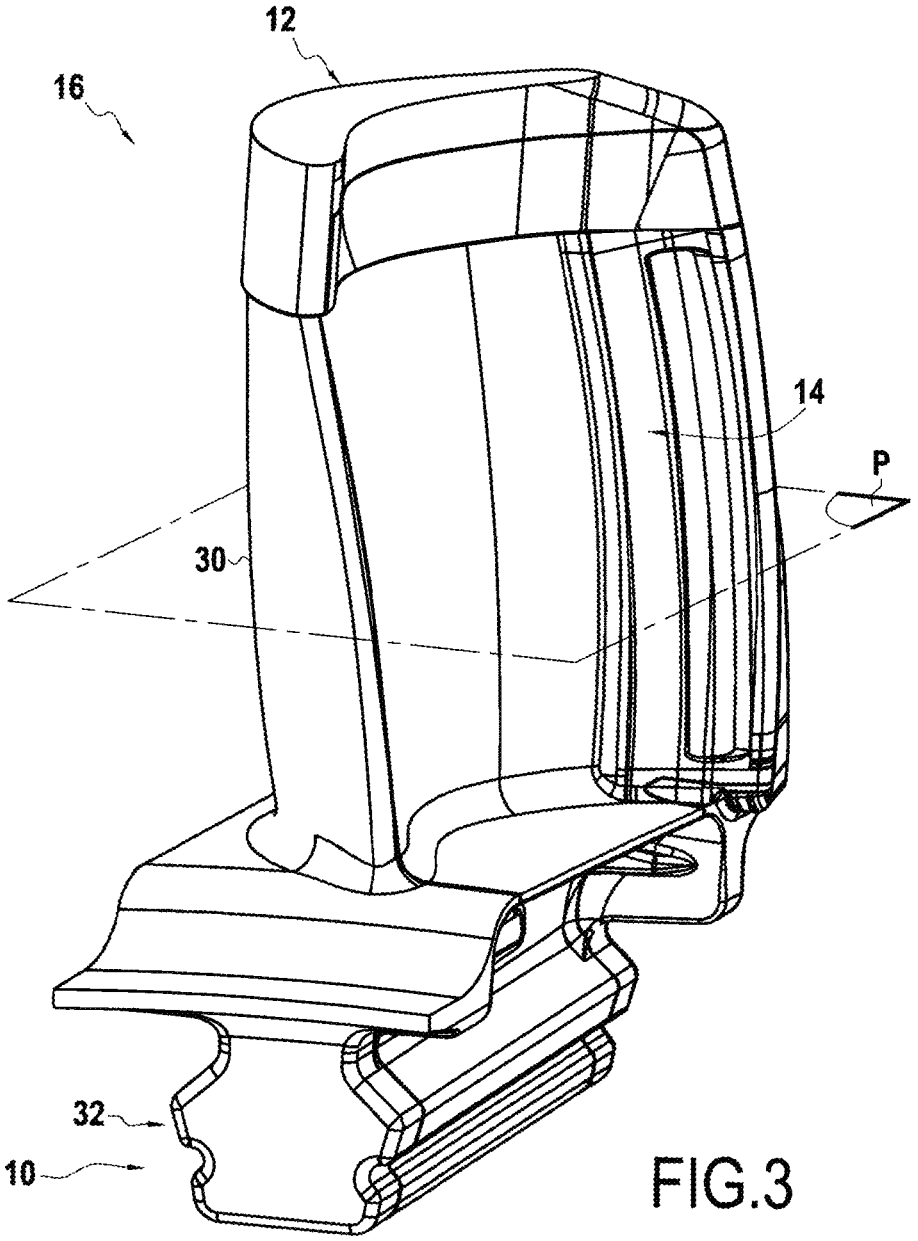
FIG. 3 is a diagrammatic perspective view of a blade pattern used while performing the method described by FIG. 1.

The pattern 16 is then made by uniting two portions, a pressure side portion 14 and a suction side portion 12, which correspond to the portions of the blade that are situated respectively on the pressure side and on the suction side (FIG. 3).

The portions of the pattern may be defined with junction zones presenting complementary shapes (cones, staircase steps, etc.). When assembling the portions of the pattern, these complementary shapes serve to ensure that the various portions of the pattern are properly positioned relative to each other, which is important for ensuring that the resulting pattern has a shape that is as close as possible to the shape specified by the digital definition for the part.

The pattern portions may also be defined with recesses and/or housings that are designed to co-operate with corresponding portions of the core, such that the core is held accurately in position by the blade portions inside the blade pattern.

Once the digital definitions of the various portions selected for forming the pattern have been obtained, these pattern portions can be fabricated.

Any method may be used for this purpose.

Nevertheless, given that the digital definition is available, it is possible in particular to fabricate one or more pattern portions by an additive method. Various rapid prototyping methods can be used.

The core 10 may also be made by an additive method, or indeed in conventional manner by injection and heat treatment.

The fabrication materials and methods used respectively for the pattern portions and for the core may be selected in such a manner that:

- the pattern portions can be eliminated by heating or in other ways without leaving any undesirable residue such as soot or traces of carbon (during step S5 described below); and
- the core can withstand the temperature stresses applied while casting the cluster of blades and can be eliminated by a chemical bath without leaving undesirable residues (during step S6, described below).

Methods other than heating can be envisaged for eliminating pattern portions. For example, they may be eliminated chemically, by hypercritical debinding, etc.

S2: Fabricating Blade Patterns

A blade pattern 16 is fabricated in two successive steps:

- during a first substep S21 the two pattern portions 12 and 14 are assembled around the core 10 (as an insert), thereby constituting a blade pattern 16. The pattern portions 12 and 14 are fastened together by adhesive. While remaining within the context of the invention, other fastening methods may be used, such as welding, mechanical assembly, e.g. by mutual engagement, and/or screw-fastening, etc.;
- during a second substep S22, the pattern 16 is finished off so that it is sealed with the exception of passages for feeding or removing material as needed by the lost pattern casting method.

S3: Fabricating the Cluster of Patterns

Figure 2:
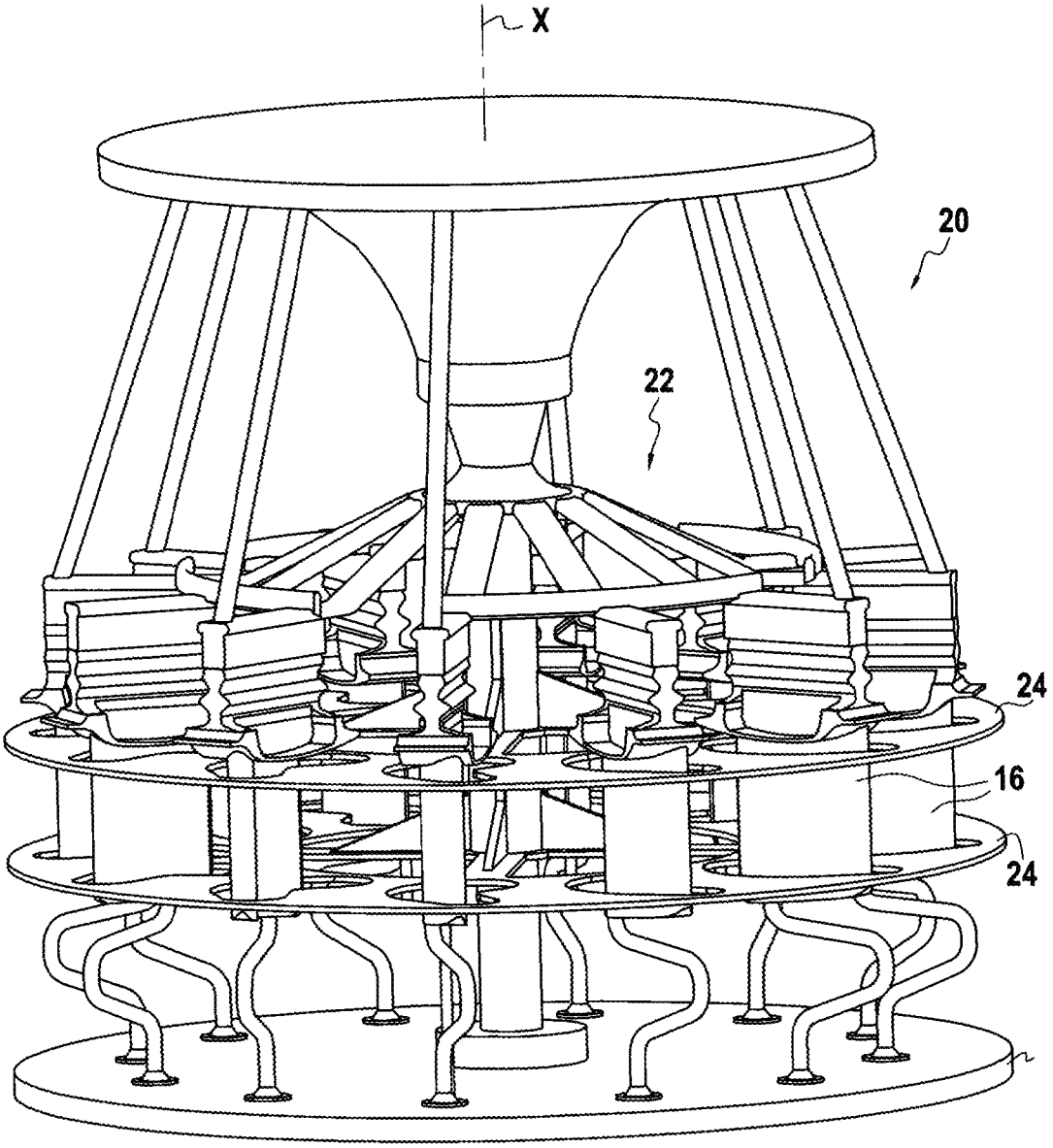
FIG. 2 is a diagrammatic perspective view of a cluster of blade patterns obtained by performing the method shown in FIG. 1.

During this step S3, a cluster 20 of wax patterns (FIG. 2) is fabricated, which cluster is also referred to as a "non-permanent" cluster. This cluster 20 is used for fabricating a shell mold by forming hollow volumes within the shell mold, in known manner.

The cluster 20 is fabricated by assembling together the blade patterns 16 as made in step S2 while also using prefabricated auxiliary elements 22.

These auxiliary elements 22 serve to form the technical portions of the shell mode, in particular the channels for feeding and removing metal, heat shields, etc. In particular, they comprise parallel disks 24, each of the disks being in the form of a tray with holes through which the blade patterns 16 pass.

The blade patterns 16 are all identical to one another. They are arranged in a circle in axial symmetry about an axis X, referred to as the casting axis. The axis X is arranged along the vertical direction during the casting operation when the molten metal is cast into the shell mold (operation described in greater detail below).

During fabrication of the shell mold, the blade patterns 16 serve to form mold cavities for molding blades; the auxiliary elements 22 serve to form in particular a sprue cup, feed channels, stiffeners, and selectors.

S4: Fabricating the Shell Mold

In step S4, the shell mold is fabricated by immersing the non-permanent cluster 20 in a slurry from which the shell is formed (this step and the subsequent steps S5 to S7 are described in greater detail in Document WO 2014/049223).

S5: Casting—Fabricating the Cluster of Castings

In this step S5, the blade patterns are eliminated by heating the shell mold in which the non-permanent cluster is to be found. Under the effects of heat, the blade patterns melt and/or burn, thereby enabling them to be removed and releasing the inside volume of the shell mold. The cluster of castings—i.e. the cluster of blades—is then formed in the shell mold by casting molten metal into it.

S6: Extracting the Cluster

In a sixth step S6, after the metal has cooled and solidified in the shell mold, the blade cores are eliminated by soaking in a basic chemical bath, and the blade cluster is knocked out from the shell mold.

S7: Finishing the Blades

Finally, in a seventh step S7, each of the blades is separated from the remainder of the cluster and is finished by machining methods and/or surface treatments.

Within the above-described blade fabrication method, the invention relates more particularly to steps S1 and S2, i.e. to fabricating the blade patterns 16. An implementation of these steps is shown in FIGS. 3 to 6.

A blade pattern 16 is a wax pattern of a blade having an airfoil 30 and a root 32.

Figure 4:
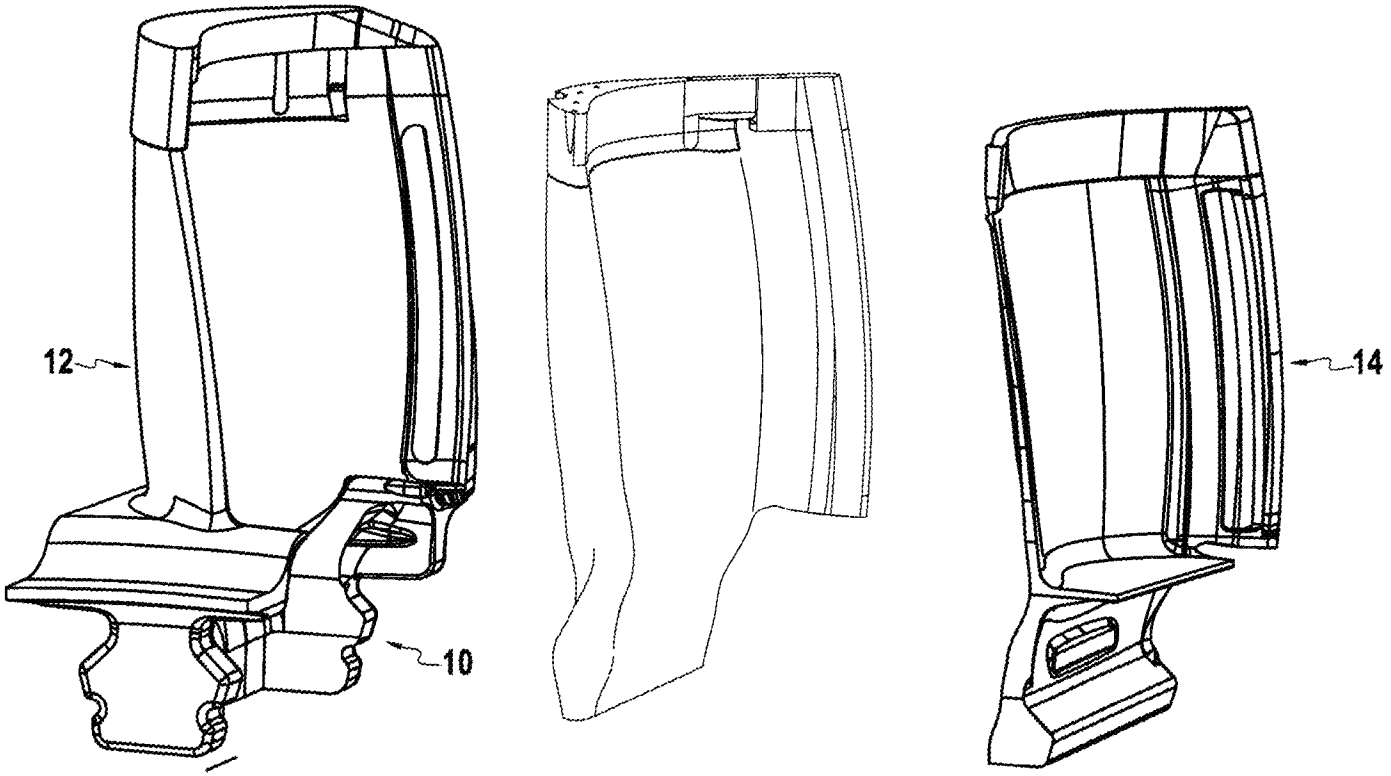
FIG. 4 is an exploded diagrammatic view in perspective of the blade pattern shown in FIG. 3.

FIG. 3 shows the blade pattern 16 that is obtained by assembling together three components: namely the suction side portion 12, the core 10, and the pressure side portion 14 (FIG. 4).

Figure 5:
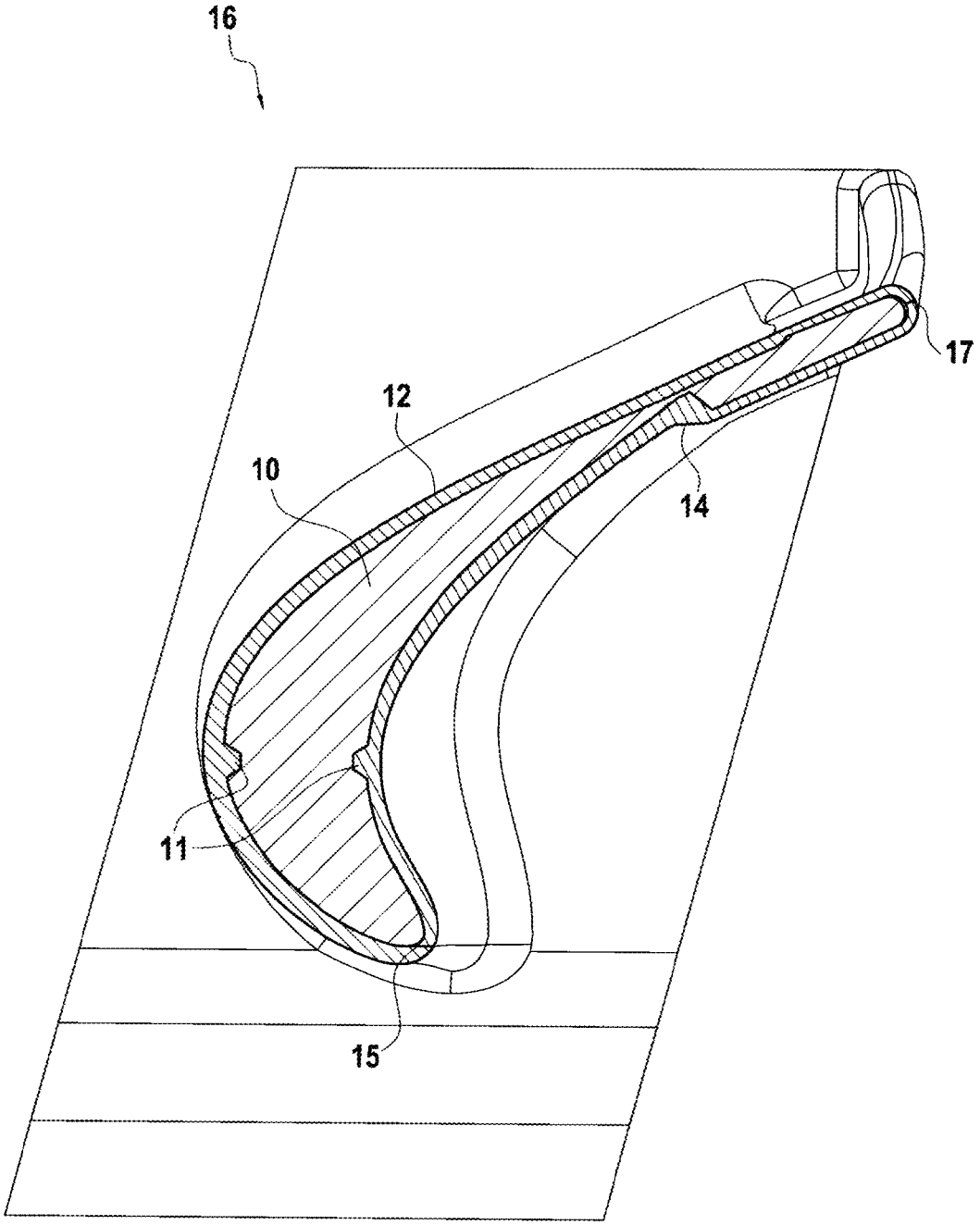
FIG. 5 is a diagrammatic section view of the blade pattern shown in FIG. 3.
Figure 6:
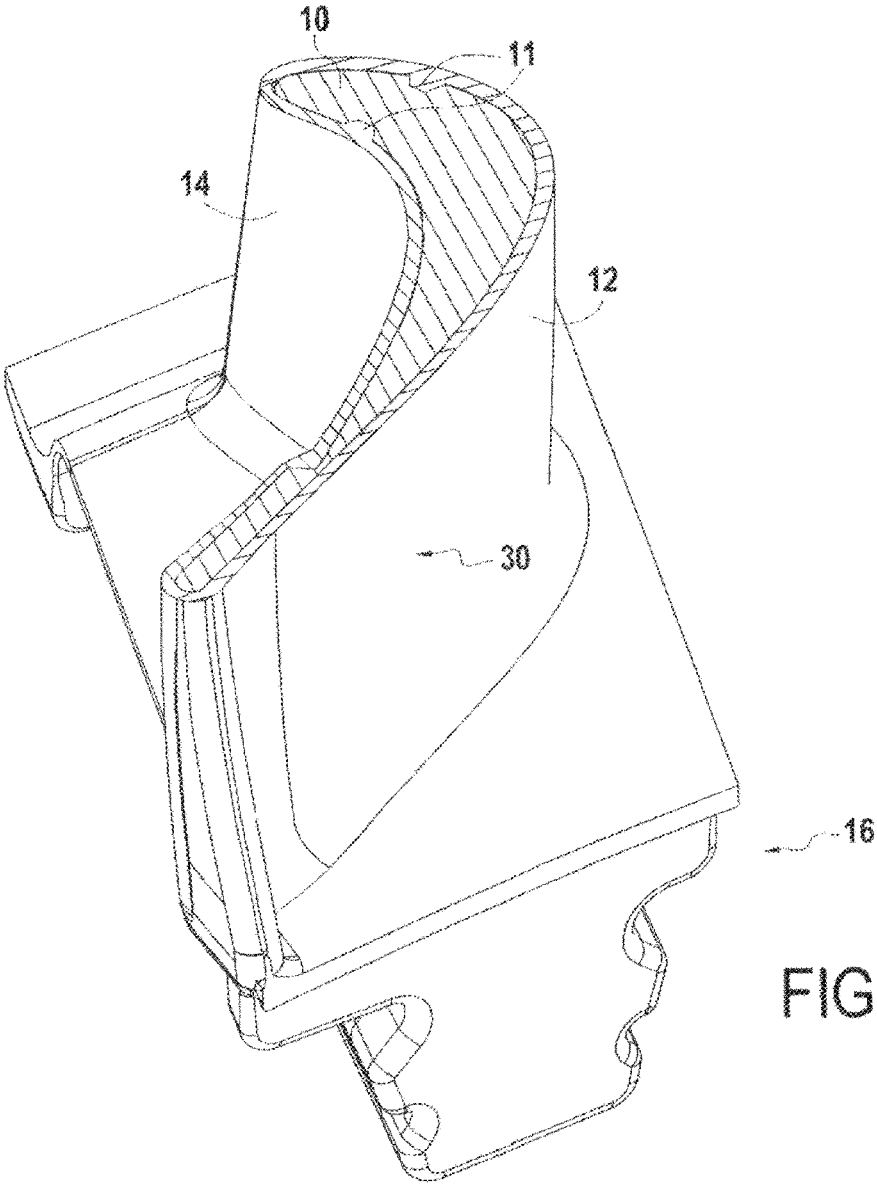
FIG. 6 is a diagrammatic perspective view showing the blade pattern section of FIG. 5.

FIGS. 5 and 6 show a section of the pattern 16 on a plane P that is perpendicular to its longitudinal axis.

The blade that the blade pattern 16 serves to fabricate is a hollow blade. Thus, in order to fabricate it by lost pattern casting, it is necessary to use a core—specifically the core 10. The shape of the core 10 defines the inside volume of the blade that it is desired to keep empty, i.e. the inside volume of the blade that is not to be filled with metal during casting.

The pattern portions 12 and 14 are provided with frustoconical projections 11, and the core 10 has corresponding holes 11 of frustoconical shape, thereby enabling the core 10 to be held accurately in position relative to the pattern portions 12 and 14.

The core 10 is made separately out of ceramic during step S1A, in conventional manner (e.g. by molding in a core box, or by additive fabrication, e.g. by sintering powder). It is made mainly out of silica.

Its material is selected in such a manner that its melting temperature is higher than 1300° C. As a result, the core does not melt during step S5 of casting the blade cluster. Conversely, this material is selected so as to be capable of being eliminated by chemical solvents in step S6.

The pattern portions 12 and 14 are fabricated separately (step S1B). They are made of material that can be eliminated: in the present example, they are made of a material that melts at low temperature. By way of example, they may be fabricated by rapid prototyping, by depositing a wax filament, or by sintering powder. By way of example, they may be made out of polymethyl methacrylate (PMMA) or out of other organic polymers. These materials can be eliminated by being raised to a temperature of the order of 1000° C. in a burnout stove, during step S5, prior to casting the metal.

The pattern portions 12 and 14 are of shapes such that together their volumes correspond substantially to the volume of the blade that it is desired to fabricate.

The portions 12 and 14 come into contact via two contact surfaces: an upstream contact surface 15 and a downstream contact surface 17. These surfaces are defined in such a manner that the core 10 and the portions 12 and 14 can be united easily and without difficulties associated with undercuts, etc.

During step S21, a thin layer of adhesive is deposited on the contact surfaces 15 and 17; the portions 12 and 14 are adhesively bonded together with the core 10 being arranged between them.

This step of assembly and adhesive bonding nevertheless does not guarantee that the pattern 16 is sealed.

Thus, during step S22, the pattern 16 is made sealed by sealing each of the contact surfaces (15, 17) between the various pattern portions.

This sealing may be obtained by causing the wax or the PMMA to melt locally so as to bond together the portions 12 and 14.

As a result of the sealing achieved in this way, during the operation S4 of fabricating the shell mold, the slurry does not penetrate into the inside of the pattern 16 (i.e. between the portions 12 and 14, and in contact with the core 10).

In the above implementation, the insert-forming core 10 is contained entirely inside the pattern 16. Nevertheless, in a variant, it is also possible for portions of the core 10 to project outside the pattern 16, as illustrated by appendices 13 in FIG. 7. In this implementation, the appendices 13 serve to anchor the core 10 in the shell mold that is made subsequently.

In order to seal the pattern 16, sealing joints 13*a* are provided between the portions of the pattern 16 and the core 10, and more particularly its appendices 13. The above-mentioned methods of sealing are equally suitable for sealing the junctions between the pattern portions and the appendices 13.

Figure 7:
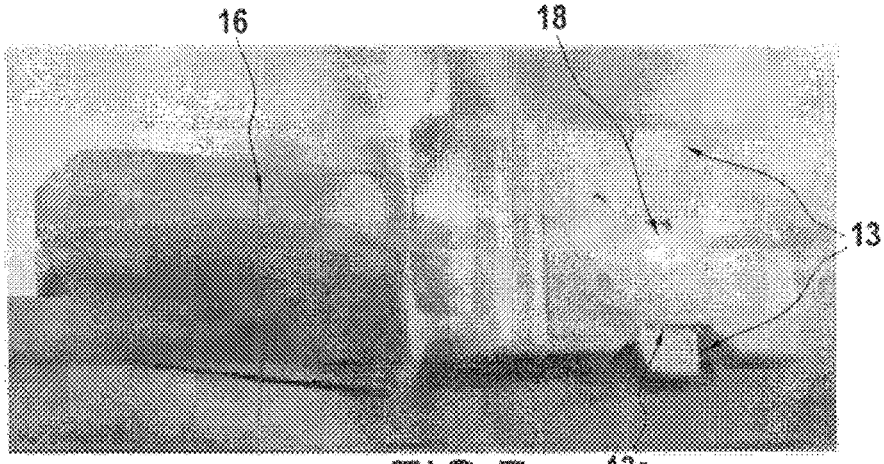
FIG. 7 is a diagrammatic perspective view of a pattern including an insert that presents appendices.

In addition, as shown in FIG. 7, an expansion zone 18 may be provided so that clearance remains between the core 10 and the shell mold that is made subsequently. Specifically, differential thermal expansion may exist between the core 10 and the shell mold during the cycle of heating the shell mold containing the core followed by the cycle of casting the parts, blades in this example. The expansion zone 18 and the resulting clearance guarantee that the core 10 does not break under the effect of the differential expansion.

Although the present invention is described with reference to specific implementations, it is clear that various modifications and changes can be undertaken on those implementations without going beyond the general ambit of the invention as defined by the claims. In addition, individual characteristics of the various implementations mentioned may be combined in additional implementations. For example, the pattern made by the method of the invention may be the pattern for a part that is to be fabricated; however it may possibly include additional portions that do not form portions of the part that is to be fabricated and that are eliminated during the finishing step (S7). Consequently, the description and the drawings should be considered in a sense that is illustrative rather than restrictive.

The invention claimed is:

1. A fabrication method for fabricating a pattern for lost pattern casting, the method comprising the following steps:

S1A) providing at least one insert;

S1B) providing at least two pattern portions in a solid state, said at least two pattern portions being made of a material that can be eliminated; and then S2) fastening directly to each other said at least two pattern portions together around at least a portion of said at least one insert in sealed manner so as to make said pattern.

2. The fabrication method according to claim 1, wherein said at least one insert comprises a core configured to be eliminated after a casting step during lost pattern casting.

3. The fabrication method according to claim 1, wherein step S1B) is performed by fabricating at least one of said at least two pattern portions of the pattern by an additive method or by injection molding.

4. The fabrication method according to claim 1, wherein step S1A) is performed by fabricating said at least one insert by an additive method or by injection molding.

5. The fabrication method according to claim 1, wherein the pattern includes an airfoil.

6. The fabrication method according to claim 5, wherein, in step S1B), exactly two portions of the pattern are provided, a suction side portion including a portion of the airfoil that is situated on a suction side, and a pressure side portion including a portion of the airfoil situated on a pressure side.

7. The fabrication method according to claim 1, wherein step S2) comprises two substeps:

S21) assembling said at least two pattern portions around said at least one portion of said at least one insert by adhesive or by welding; and S22) sealing the pattern.

8. A method of fabricating a lost pattern casting, comprising:

fabricating a pattern using the method according to claim 1;

fabricating a shell mold using the fabricated pattern; and forming a casting using the fabricated shell mold.

* * * * *